US006689227B2

(12) United States Patent
Sahay

(10) Patent No.: US 6,689,227 B2
(45) Date of Patent: Feb. 10, 2004

(54) ECO-FRIENDLY STARCH QUENCHANTS

(75) Inventor: Satyam Suraj Sahay, Pune (IN)

(73) Assignee: Tata Consultancy Services, division of Tata Sons LTD (IN)

( * ) Notice: Subject to any disclaimer, the term of this patent is extended or adjusted under 35 U.S.C. 154(b) by 154 days.

(21) Appl. No.: 10/038,127

(22) Filed: Jan. 2, 2002

(65) Prior Publication Data

US 2002/0134475 A1 Sep. 26, 2002

(30) Foreign Application Priority Data

Jan. 25, 2001 (IN) ..... 94/MUM/2001

(51) Int. Cl.[7] ..... C21D 1/56; C21D 1/60

(52) U.S. Cl. ..... 148/28; 148/559; 148/638; 148/660; 148/703; 148/713; 252/71

(58) Field of Search ..... 148/559, 638, 148/660, 703, 713, 28; 252/71

(56) References Cited

U.S. PATENT DOCUMENTS 3,022,205 A * 2/1962 Chase et al. ..... 148/28
3,220,893 A * 11/1965 Blackwood et al. ..... 148/28
3,475,232 A * 10/1969 Lewis et al. ..... 148/28
4,381,205 A * 4/1983 Warchol ..... 148/28
4,441,937 A * 4/1984 Gosset et al. ..... 148/28

* cited by examiner

*Primary Examiner*—Robert R. Koehler
(74) *Attorney, Agent, or Firm*—Donald R. Boys; Central Coast Patent Agency, Inc.

(57) ABSTRACT

This invention relates to application of eco-friendly starch solution as a quenching medium for heated metal parts fabricated from steel, alloy steel, aluminum and aluminum alloys. Depending on the material grade, critical temperature and desired cooling rate, various types of starch solution can be used and the composition and concentration of the starch quenchant can be tailored to provide the required cooling characteristics for wide range of materials. In particular the starch solutions have the potential to replace quenching oil. The starch solutions are environmentally friendly, having no toxic fumes and no after usage disposal liabilities as compared to oil fumes.

23 Claims, 3 Drawing Sheets

ECO-FRIENDLY STARCH QUENCHANTS

FIELD OF THE INVENTION

This invention relates to heat-treating methods and particularly to application of eco-friendly starch solution as quenchant for quenching heated metal parts fabricated from steel, alloy steel, aluminum and other nonferrous alloys.

CROSS-REFERENCE TO RELATED DOCUMENTS

The present invention claims priority to Indian utility patent application (Title: Method of Quenching) No. 94/MUM/2001, filed in India on Jun. 7, 2001 which claims priority to Indian provisional patent application No. 94/MUM/2001, filed Jan. 25, 2001 in India.

BACKGROUND OF THE INVENTION

Hardening of steel components is one of the most commonly practiced heat treatment operations in the steel industry. The hardening process comprises heating the steel components to austenitizing temperature (~800–1000° C.), soaking at that temperature for thermal homogenization, followed by quenching in an appropriate medium to room temperature. Quenching is a process whereby a steel component heated to a given elevated temperature is rapidly cooled by immersion in a quench bath containing compositions having a high heat-extracting potential such as air, water, brines, oils or polymer solutions.

The rate of cooling is an important parameter during the quenching process. Cooling rates are dependent on factors such as the size, shape and composition of the component being quenched as well as the composition, concentration, degree of circulation and temperature of the quench bath.

In steel, depending on the cooling rate during quenching, the austenite phase can be transformed into a variety of other phases such as ferrite, pearlite, bainite and martensite. Of the various phases, ferrite is the softest phase, whereas martensite is the hardest phase. Slow cooling rate results in formation of ferrite phase, whereas fast cooling rate provides martensite phase. Formation of martensite phase is generally the main aim of hardening treatment.

It must be noted that cooling rates are not uniform throughout a component; surface regions are better able to dissipate heat and thus cool faster than interior regions. The difference in cooling rates and temperature gradient within the component produce thermal stresses. If the cooling rate is very high, the thermal stresses can result into warping, distortion and even cracking of the component.

Therefore, during the quenching process, the cooling rate of a component should be fast enough to prevent formation of soft ferrite phase, but not too fast to prevent distortion and cracking. The quantification of too fast or too slow cooling rate mainly depends on the steel grade, and accordingly appropriate quenching media is selected for a particular grade of steel. For example, medium alloyed air hardening grade steels (AISI A2, A3, A4, A10, etc.) can be hardened by air cooling, oil hardening grades (AISI O1, O2, O6, etc.) can be hardened through quenching in oil, whereas water hardening grades (AISI W1, W2, W3, etc.) require high cooling rates which can be obtained only through water and brine quenching.

Of the various quenching media, oil is one of the most common quenching media in the industry. Generally, quenching oil provides moderate cooling rate and therefore results in minimal distortion in the component. Therefore, many of the precision components such as gears and bearing rings are hardened by oil quenching.

Although quenching oil exhibits this highly advantageous cooling response, currently, the use of oil as a common quenching medium for hardening of steel is associated with several environmental liabilities such as oil fumes, smoke emissions, fire hazard, oil spills, leaking underground storage tanks, ground water contamination and waste oil disposal liabilities. With increasing environmental awareness as well as strict regulations, the use of oil as quenching media is being discouraged in many of the environmentally conscious countries. For example, in USA, used quenching oil is considered a hazardous waste and its disposal is regulated by EPA's strict used oil management standards. In the comprehensive technology roadmap "Vision 2020" prepared by *ASM Heat Treating Society*, in close collaboration with leaders in heat treatment industries, replacement of oil as a quenching media has been given very high importance to achieve zero emissions from heat treatment industry.

Significant efforts have been put in towards the development of synthetic organic polymer quenching media as an alternative to Oil. However, most of these synthetic quenchants are proprietary and expensive which makes their usage very limited.

U.S. Pat. No. 3,022,205 discloses an aqueous quenchant medium containing between 0.2 g and 4.5 g. per gallon of water, of an ethylene oxide polymer having a molecular weight of between 100,000 and several million.

U.S. Pat. No. 3,220,893 discloses a metal quenchant medium containing an aqueous solution of an oxyalkylene polymer containing both oxyethylene units and higher molecular weight oxyalkylene units such as units derived from propylene oxide. The polymers are further described as having an oxyethylene to oxyalkylene ratio by weight of from about 70:30 to about 90:10, and an average molecular weight of from 600 to 40,000. The specific polymer exemplified is a polyglycol containing 75 percent by weight of oxyethylene units and 25 percent by weight of oxypropylene units, having a viscosity of about 90,000 Saybolt seconds at 100 degrees F. and an average molecular weight of from about 12,000 to about 14,000.

U.S. Pat. No. 3,475,232 discloses an aqueous quenchant containing a normally liquid water soluble oxyalkylene polymer having oxyethylene and higher molecular weight oxyalkylene units, and a water soluble alcohol selected from the group consisting of glycerol, glycols containing from 2 to 7 carbon atoms, and mono-lower alkyl ethers of said glycols in which the alkyl group contains from 1 to 4 carbon atoms. A polymer comprising about 75 percent by weight of oxyethylene units and about 25 percent by weight of oxypropylene units, having a viscosity of about 150,000 Saybolt seconds at 100 degrees F. is particularly preferred.

U.S. Pat. No. 4,381,205 discloses a metal quenching process using an aqueous quenchant bath containing from about 0.5 to about 50% by weight of the bath, of a liquid, water-soluble or water dispersible capped polyether polyol.

An object of this invention is to provide a suitable eco-friendly natural quenchant, which can replace quenching oil from the heat treatment industry. Commercial aspects such as being low-cost and easily available have also been considered.

It is a further object of this invention that the quenchant should have following characteristics:

(i) The quenching intensity should be at least equivalent to that of oil, and at the same time it should not be very high to introduce distortion and cracking in the as quenched component.

(ii) It should be reusable and possess long shelf life. It should not age appreciably with time and repeated use.

(iii) It should not generate fumes during quenching operation.

(iv) The spurting should be minimal during the quenching operation. This is especially important for salt bath hardening, where vigorous spurting occurs during water quenching.

(v) It should be biodegradable and the disposal of used quenchant should not pose any environmental problem.

(vi) In addition to the above characteristics, commercial issues such as: low cost and availability must be addressed.

SUMMARY OF THE INVENTION

In a preferred embodiment of the present invention a method of heat treating a heated metal part is provided, comprising the steps of (a) preparing a quenching bath comprising starch dissolved in water; and (b) immersing the heated metal part in the quenching bath for a period of time to accomplish the heat treating. The starch in one embodiment may be cornstarch, and may vary in concentration from two percent to four percent inclusive by weight. The starch in another embodiment is laundry starch, and in some embodiments may vary in concentration from two percent to three percent by weight. In other embodiments the starch is derived from one of potato, rice or tapioca.

In various embodiments the water is preferably at a temperature of from eighty-five to ninety-five degrees Celsius inclusive. In a preferred method, in step (a), after adding the starch to the water, the slurry so formed is left unmolested for from five to fifteen minutes inclusive, prior to step (b). Further, the temperature of the resulting solution is allowed to decline to room temperature before step (b). In some embodiments there is a further step for adding formaldehyde, as a preservative, to the solution prior to step (b). The concentration of formaldehyde is typically from about one-half to one percent by weight.

In another aspect of the invention a quenching liquid for heat treating a heated metal part is provided, comprising a volume of water as a vehicle, and starch dissolved in the water vehicle. In a preferred embodiment the starch is cornstarch. The concentration of cornstarch in the water vehicle is preferably from two percent to five percent inclusive by weight. In some other embodiments the starch is laundry starch, and concentration of laundry starch in the water vehicle is from two percent to three percent by weight. In other embodiments the starch is derived from one of potato, rice or tapioca, and other sources may be used as well.

In preparing the quenchant the water vehicle is preferably at a temperature of from eighty-five to ninety-five degrees Celsius inclusive while the starch is dissolved in the water vehicle, and, after adding the starch to the water vehicle, the slurry so formed is left unmolested for from five to fifteen minutes inclusive. After dissolving the starch in the water, the temperature of the resulting solution is allowed to decline to room temperature before use as a quenchant ion heat treating.

In many embodiments a formaldehyde component is added as a preservative, and the concentration of formaldehyde is preferably about one percent by weight.

In yet another aspect of the invention a method for preparing a quenchant for heat treating is provided, comprising the steps of (a) determining, for a particular part to be treated, a material grade, critical temperature, and a desired cooling rate for the part to be treated; and (b) tailoring the quenchant to the task by dissolving an available starch material in a solvent to match the characteristics from step (a), including the desired cooling rate.

In various embodiments of the invention taught in enabling detail below, for the first time, a truly environmentally safe quenchant for heat treating is provided, which is also economical and effective.

BRIEF DESCRIPTION OF THE DRAWING FIGURES

DESCRIPTION OF THE PREFERRED EMBODIMENTS

In accordance with this invention it has been found that the best approximation of the cooling curve characteristic of quenching oil can be achieved using an aqueous solution of starch with or without the addition of gums and resins.

Starch is a low cost, abundantly available natural organic product. In this invention, potential of starch solution for application as quenching media has been envisaged. Commercially, starch is available in the form of powder. Starch solution is obtained by breaking up of hydrogen bonds between the molecules by hydration, which results in swelling of starch granules and solubilization of starch molecules. These events, referred collectively as gelatinization, are commonly affected by heating a slurry of starch granules in water.

Figure 1:
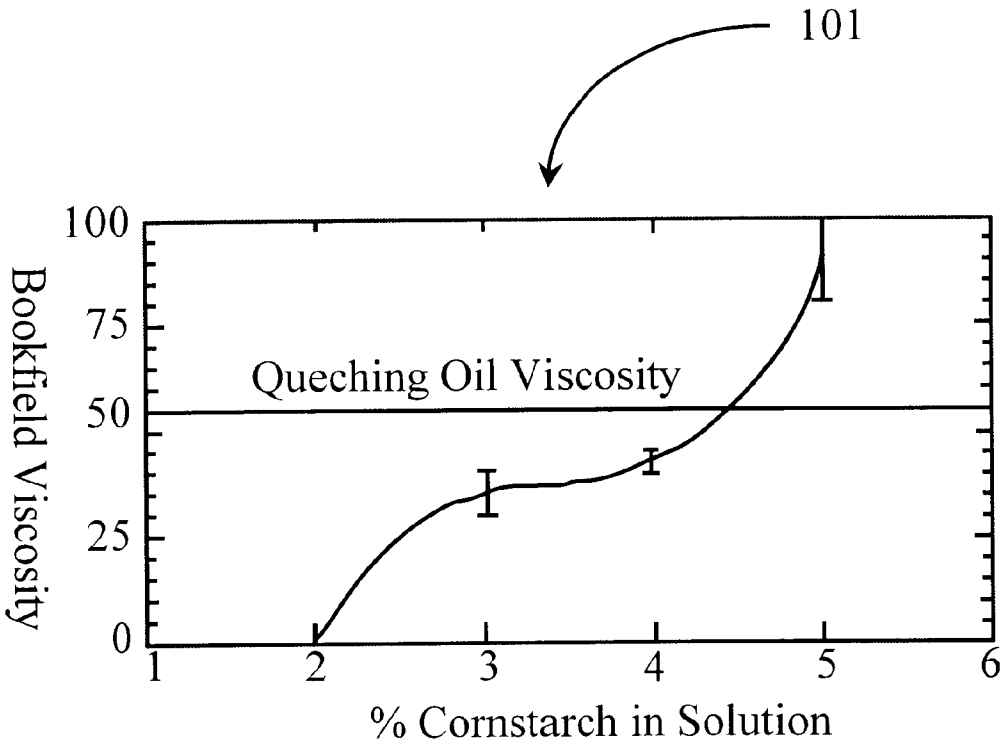
FIG. 1 is a graph plotting variation in viscosity with weight percentage of cornstarch in solution. The viscosity of commercial quenching oil is also compared in this figure.

One preferred embodiment of the invention is illustrated in FIG. 1 by a graph 101, which uses cornstarch at concentrations between about 2% and 5% product by weight, which closely approximates the desired viscosity of the quenching oil. Cornstarch can be readily cooked at low temperature and is also stable during use. Further the cornstarch is not unstable during aging or when subjected to heat. Alternatively, laundry starch between 2–3 wt. % can also be used. It may be noted that depending on the steel grade, the type of starch and its concentration can be tailored to match the desired cooling rate.

A preferred cornstarch quenchant in an embodiment of this invention was prepared in the following manner:

Required quantities of corn starch powder and water were taken, depending upon the concentration of starch solution to be prepared, and the corn starch was dissolved in water at 90° C. The slurry was held at this temperature for about 10 minutes before cooling it down to room temperature. After holding at 90° C. for a period of 10 minutes almost complete gelatinization (>90%) takes place. During the heating and cooling cycle, stirring of the solution is required to prevent granulation and lump formation. After the starch solution was prepared, 0.5–1% (by wt.) formaldehyde was added in order to increase shelf life. Starch solution without formaldehyde degraded within a day, whereas no degradation of the starch solution containing formaldehyde was observed even after three to four weeks.

Quenchant Characterization (i) Viscosity Measurements:

Referring now to FIG. 1 graph 101, viscosity of the quenchant plays a major role in heat transfer during quenching, therefore governing the quenching intensity. Viscosity of 2%, 3%, 4% and 5% (by wt.) cornstarch solutions were measured by Brookfield viscometer and compared with the viscosity of quenching oil. The variation in viscosity with change in concentration is plotted as seen in FIG. 1, graph 101 of the accompanying drawings. The graph 101 in FIG. 1 indicates that the viscosity of quenching oil is close to 4 wt. % cornstarch solution. Although viscosity is an important parameter for comparing the quenchant characteristics, other parameters such as thermal conductivity and boiling characteristics of the media also affect the quenching performance. The change in viscosity of a starch solution of a particular concentration on changing the pH of the solution was also measured. The results indicated that the viscosity of the starch solution increases as it is made either acidic or basic.

(ii) Cooling Curve Measurements in Quenching Media

The primary requirement from a quenching media is to provide the desired cooling rate or quenching intensity. Of all the available methods of measuring quenching intensity, those measuring temperature as a function of time (cooling curve) at a specified point within the test specimen are commonly used. Worldwide, the standard method for testing of industrial quenching oils is by using a solid Inconel probe (ISO 9950) covered by an Inconel sheath.

Figure 2:
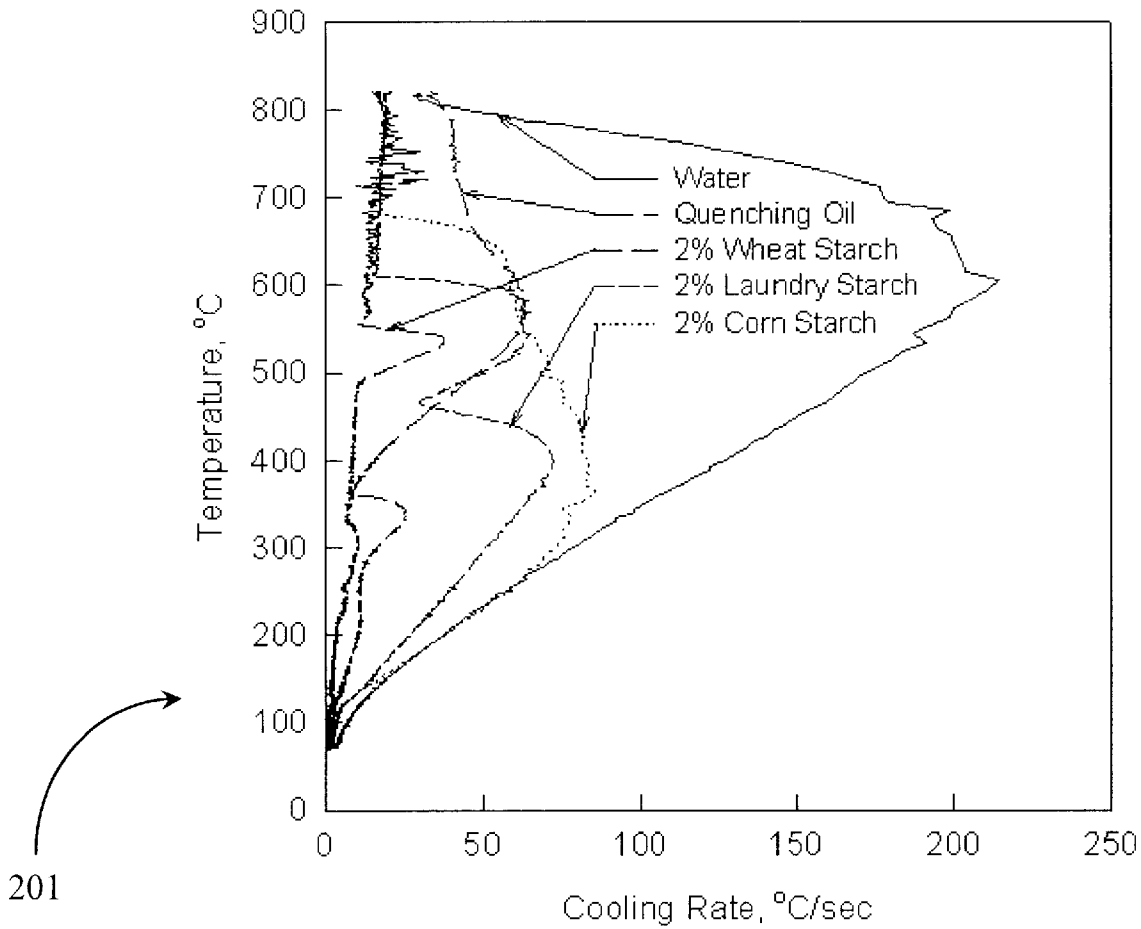
FIG. 2 is a graph, showing variation in cooling rates of various ingredients and cooling mediums with temperature.

Referring now to FIG. 2 of the accompanying drawings, experiments were performed to determine the cooling rate imparted by a variety of starch solutions, water, and industrial quenching oil, as is illustrated by a graph 201. The cooling rates were obtained by recording the rate at which a particular quenchant cooled the standard Inconel 600 Probe, fabricated as per international standard ISO/DIS 9950. During the cooling curve experimentation, the thermocouples were heated for 10 minutes in a muffle furnace held at 825° C., and quenched in two liters of quenching media. During the holding and quenching period, temperature variation with time was recorded using the HP datalogger system at 0.1 sec intervals. During quenching no stirring was done. The cooling curves for various concentrations of starch solutions, filtered potable water, air, and quenching oil are shown in FIG. 2, graph 201 of the accompanying drawings. The results are tabulated in the Table 1 below.

TABLE 1

Summary of the Cooling Curve Experiments

| S.N. | Medium | Wt. % Concn | Peak Cooling Rate, ° C./sec | Peak Temperature |
|---|---|---|---|---|
| 1. | Water | ~ | 214° C./sec | 604° C. |
| 2. | Quenching Oil | ~ | 65° C./sec | 570° C. |
| 3. | Laundry Starch | 2% | 65° C./sec | 550° C. |
| 4. | Laundry Starch | 3% | 59° C./sec | 350° C. |
| 7. | Corn Starch | 2% | 80° C./sec | 450° C. |
| 8. | Corn Starch | 3% | 90° C./sec | 425° C. |
| 9. | Corn Starch | 4% | 38° C./sec | 253° C. |
| 5. | Wheat Starch | 2% | 38° C./sec | 534° C. |

The general observations are as follows:

1. The maximum cooling rate imparted by water was 214° C./sec at 605° C. This rate of cooling, although greater than the critical cooling rate for almost all grades of steel, is very high and causes distortion of the component being quenched and hence is undesirable.
2. The cooling rate imparted by quenching oil (A cracked petroleum product commercially available from Indian Oil) was 65° C./sec at 570° C. and is an optimum cooling rate. However, oil quenching is hazardous as it generates toxic fumes of oil during quenching and the disposal of used quenching oil also poses environmental hazards.
3. The cooling rate imparted by 2 wt. % laundry starch was 65° C./sec at two different temperatures of 580° C. and 390° C., which is equivalent to that imparted by oil. When the concentration was increased to 3 wt. % laundry starch, the peak cooling rate slightly decreased to 59° C./sec, but more importantly the peak temperature was significantly reduced to 350° C. The use of laundry starch as a quenchant poses no environmental liabilities and it maintains its stability over a long period of time.
4. The cooling rates imparted by 3 wt. % and 2 wt. % cornstarch solutions were 90° C./sec between 450–400° C. and 80° C./sec between 450–400° C. respectively, which is an optimum cooling rate. The use of cornstarch is environmentally friendly, however, addition of formaldehyde in very small amounts of 0.5–1.0% by weight of the starch solution is necessary to maintain stability over long period of time. 4 wt. % corn starch gave a very low cooling rate of 38° C./sec. For 2 wt. % and 3 wt. % starch, the peak cooling rate and peak temperature were very close. Only the start of peak temperature was at 680° C. for 2 wt. % corn starch as opposed to 560° C. for 3 wt. % corn starch.
5. The cooling rate imparted by 2 wt. % wheat starch was 38° C./sec at 534° C., which is lower than the critical cooling rate required and hence is not desirable.
6. Typically, it was observed that with increase in starch concentration, the cooling rate decreases and the peak temperature shifts towards lower temperature. Depending on the grade of steel, the starch type and concentration can be varied to obtain an optimal cooling rate.

Industrial Scale Experimentation in Accordance with this Invention

Four components of EN 31 grade steel were taken, and after heating in an industrial salt bath furnace they were quenched in oil, and in 2%, 3% and 4% (by weight) corn starch solutions. During the oil quenching, large amount of fumes were observed whereas no such fumes were observed while quenching in starch solutions. Little spurting was observed while quenching in starch solution while no spurting took place during oil quenching. However, compared to vigorous spurting observed during water quenching, the spurting observed during quenching in starch solution is much less and should not pose a working hazard.

Subsequently, hardness measurements were carried out on all the quenched samples. Four measurements were made on each of the quenched components. The measured hardness values are plotted in FIG. 3 of the accompanying drawings in a graph 301.

Figure 3:
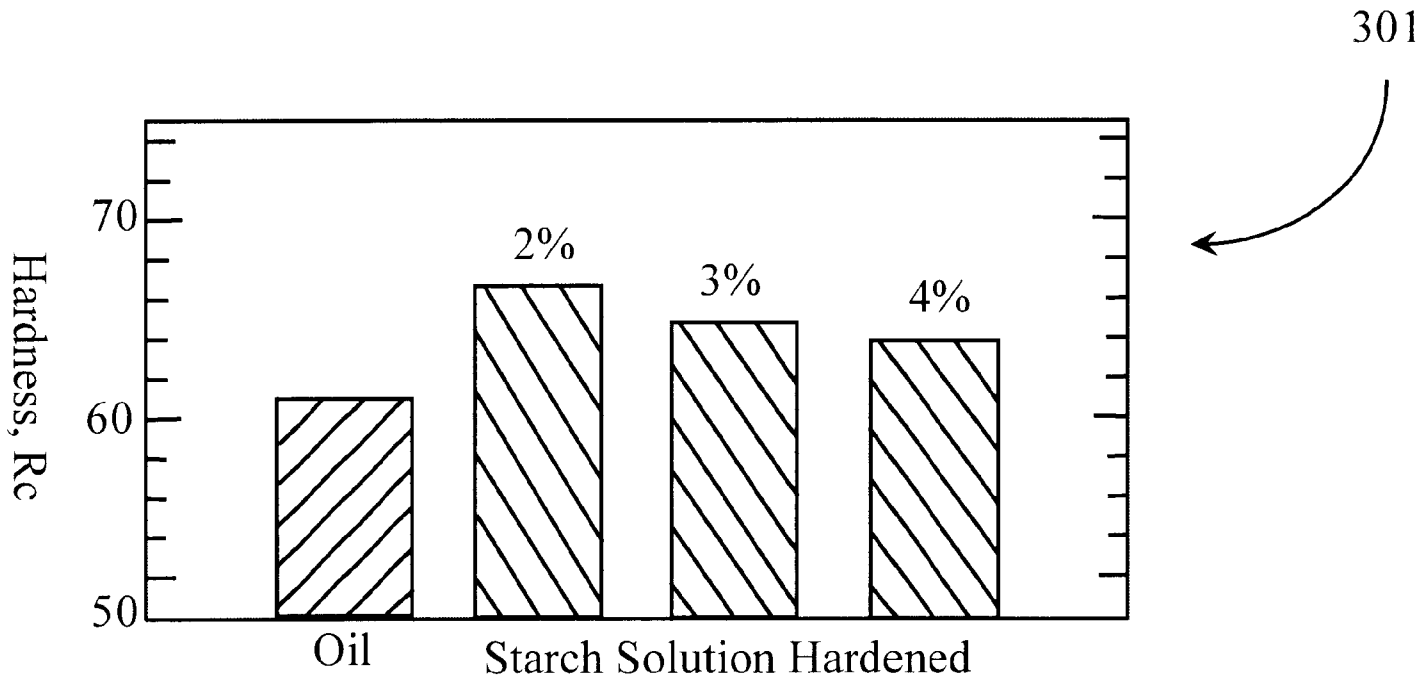
FIG. 3 is a graph, exhibiting hardness achieved in EN 31 grade steel component for various quenching medium.

As is evident in the FIG. 3, graph 301, hardness values of components quenched in starch solutions are slightly higher than for the oil quenched components. The slight decrease in hardness value with increase in starch concentration, observed in the figure, may be due to the increased viscosity and decreased quenching power (cooling rate) with increased concentration. More important is that all the four components satisfied the desired hardness value of greater than 60 Rc, and therefore shows that the starch solution can be used as an alternate quenchant to oil.

Microstructures of the oil quenched component and the component quenched in 3 wt. % starch solutions were observed. The two microstructures were very similar and showed uniform dispersion of carbides. The observed microstructures are also similar to the oil quenched microstructure reported in literature.

The experimentation shows that starch based solutions have the potential to be used as quenchants for industrial hardening operations. This quenchant will offer following benefits:

(a) The starch solutions offer the quenching power similar to the oil media
(b) The concentration can be tailored depending on the steel grade and the desired cooling rate
(c) It is eco-friendly with no hazardous fumes or disposal liabilities, which are major concerns during oil quenching.
(d) The spurting is minimal and should not pose any working hazard.
(e) For improving shelf life, the biodegradation of starch solution can be inhibited by small addition of formaldehyde solution.
(f) It is relatively inexpensive and easy to prepare, therefore it can be readily implemented by both large and small scale heat treaters.

This invention therefore envisages the feasibility of replacing quenching oil as a quenchant by starch solutions. The starch solutions are environmentally friendly, having no toxic fumes and no after usage disposal liabilities as compared to oil fumes.

Depending on the grade of steel, critical temperature and desired cooling rate, the composition and concentration of the starch quenchant can be tailored to provide the required cooling characteristics.

Other biodegradable materials like sorghum, gum, and resins can be added to the starch or the starch can be used as a combination of one or more starches from different sources such as corn, potato, rice and tapioca [sago] in accordance with alternative embodiments of this invention.

As will be readily appreciated, numerous variations and combinations of the features set forth above can be utilized without departing from the present invention as set forth in the above description of the invention. These quenchants can also be used for quenching other non-ferrous materials. Such variations are not regarded as a departure from the spirit and scope of the invention, and all such modifications are intended to be included within the scope of the above description.

What is claimed is:

1. A method of heat treating a heated metal part comprising the steps of:

(a) preparing a quenching bath comprising starch dissolved in water; and (b) immersing the heated metal part in the quenching bath for a period of time to accomplish the heat treating.

2. The method of claim 1 wherein, in step (a), the starch is cornstarch.

3. The method of claim 2 wherein the concentration of cornstarch in water is from two percent to four percent inclusive by weight.

4. The method of claim 1 wherein, in step (a), the starch is laundry starch.

5. The method of claim 4 wherein the concentration of laundry starch in water is from two percent to three percent by weight.

6. The method of claim 1 wherein the starch is derived from one of potato, rice or tapioca.

7. The method of claim 1 wherein, in step (a), the water is at a temperature of from eighty-five to ninety-five degrees Celsius inclusive.

8. The method of claim 1 wherein, in step (a), after adding the starch to the water, the slurry so formed is left unmolested for from five to fifteen minutes inclusive, prior to step (b).

9. The method of claim 7 wherein, in step (a), after dissolving the starch in the water, the temperature of the resulting solution is allowed to decline to room temperature before step (b).

10. The method of claim 1 further comprising a step for adding formaldehyde, as a preservative, to the solution prior to step (b).

11. The method of claim 10 wherein the concentration of formaldehyde is from about one-half to one percent by weight.

12. A quenching liquid for heat treating a heated metal part comprising:

a volume of water as a vehicle; and starch dissolved in the water vehicle.

13. The quenching liquid of claim 12 wherein the starch is cornstarch.

14. The quenching liquid of claim 13 wherein the concentration of cornstarch in the water vehicle is from two percent to five percent inclusive by weight.

15. The quenching liquid of claim 12 wherein the starch is laundry starch.

16. The quenching liquid of claim 15 wherein the concentration of laundry starch in the water vehicle is from two percent to three percent by weight.

17. The quenching liquid of claim 12 wherein the starch is derived from one of potato, rice or tapioca.

18. The quenching liquid of claim 12 wherein the water vehicle is at a temperature of from eighty-five to ninety-five degrees Celsius inclusive while the starch is dissolved in the water vehicle.

19. The quenching liquid of claim 12 wherein, after adding the starch to the water vehicle, the slurry so formed is left unmolested for from five to fifteen minutes inclusive.

20. The quenching liquid of claim 18 wherein, after dissolving the starch in the water, the temperature of the resulting solution is allowed to decline to room temperature before use as a quenchant ion heat treating.

21. The quenching liquid of claim 12 further comprising a formaldehyde component, as a preservative.

22. The quenching liquid of claim 21 wherein the concentration of formaldehyde is about one percent by weight.

23. A method for preparing a quenchant for heat treating, comprising the steps of:

(a) determining, for a particular part to be treated, a material grade, critical temperature, and a desired cooling rate for the part to be treated; and (b) tailoring the quenchant to the task by dissolving an available starch material in a solvent to match the characteristics from step (a), including the desired cooling rate.

* * * * *